US009022010B2

(12) United States Patent
Shibata et al.

(10) Patent No.: US 9,022,010 B2
(45) **Date of Patent: *May 5, 2015**

(54) IGNITION SYSTEM

(71) Applicant: Denso Corporation, Kariya, Aichi-pref. (JP)

(72) Inventors: Masamichi Shibata, Toyota (JP); Yuji Kajita, Chita-gun (JP); Atsuya Mizutani, Nagoya (JP); Koichi Hattori, Ichinomiya (JP); Yasuomi Imanaka, Obu (JP)

(73) Assignee: Denso Corporation, Kariya (JP)

( * ) Notice: Subject to any disclaimer, the term of this patent is extended or adjusted under 35 U.S.C. 154(b) by 90 days.

This patent is subject to a terminal disclaimer.

(21) Appl. No.: 13/758,428

(22) Filed: Feb. 4, 2013

(65) Prior Publication Data

US 2013/0200816 A1 Aug. 8, 2013

(30) Foreign Application Priority Data

Feb. 8, 2012 (JP) ..... 2012-025109

(51) Int. Cl.

| | |
|---|---|
| ***F02P 1/08*** | (2006.01) |
| ***H01T 13/44*** | (2006.01) |
| ***F02P 3/055*** | (2006.01) |
| ***F02P 9/00*** | (2006.01) |
| *F02P 3/04* | (2006.01) |

(52) U.S. Cl.

CPC ..... *H01T 13/44* (2013.01); *F02P 3/0407* (2013.01); *F02P 3/0552* (2013.01); *F02P 9/002* (2013.01)

(58) Field of Classification Search

CPC ..... F02P 17/12; F02P 3/051; F02P 2017/125; F02P 3/0453; Y02T 10/46

USPC ..... 361/57, 263; 123/596, 630, 634

See application file for complete search history.

(56) References Cited

U.S. PATENT DOCUMENTS

| | | | | |
|---|---|---|---|---|
| 3,809,043 | A * | 5/1974 | Nagasawa | 123/599 |
| 4,911,126 | A * | 3/1990 | Notaras et al. | 123/406.54 |
| 5,503,132 | A * | 4/1996 | Miyata et al. | 123/630 |
| 6,539,930 | B2 * | 4/2003 | Inagaki | 123/655 |
| 7,559,319 | B2 * | 7/2009 | Idogawa et al. | 123/652 |
| 7,663,857 | B2 * | 2/2010 | Enomoto et al. | 361/139 |
| 2002/0000809 | A1 * | 1/2002 | Karau et al. | 324/380 |
| 2002/0079900 | A1 * | 6/2002 | Inagaki | 324/378 |
| 2004/0084035 | A1 * | 5/2004 | Newton | 123/630 |

(Continued)

FOREIGN PATENT DOCUMENTS

| | | |
|---|---|---|
| JP | A-55-66659 | 5/1980 |
| JP | A-61-178561 | 8/1986 |
| JP | B2-6-80313 | 10/1994 |

*Primary Examiner* — Crystal L Hammond

(74) *Attorney, Agent, or Firm* — Oliff PLC

(57) ABSTRACT

An ignition system is provided, which can restrict decreasing of constant-voltage duration of a spark plug and effectively prevents the occurrence of an accidental fire in an engine. A typical ignition system includes a secondary coil having one end connected to a positive side of a battery via a low-voltage side path and the other end connected to a center electrode via a connecting path which connects the secondary coil and the spark plug. A constant-voltage path having a grounded end is connected to the connecting path. A block diode is arranged between the secondary coil and a point where the constant-voltage path is connected with the connecting path. A Zener diode is disposed within the constant-voltage path. Each anode of the block diode and the Zener diode is mutually connected.

4 Claims, 5 Drawing Sheets

(56) References Cited

U.S. PATENT DOCUMENTS

2005/0134281 A1* 6/2005 Zhu et al. ..... 324/380
2006/0027211 A1* 2/2006 Naruse et al. ..... 123/406.14
2006/0027220 A1* 2/2006 Kawakita et al. ..... 123/618
2006/0152865 A1* 7/2006 Nair et al. ..... 361/35
2006/0174858 A1* 8/2006 Kojima et al. ..... 123/630
2006/0213489 A1* 9/2006 Moran et al. ..... 123/651
2007/0017493 A1* 1/2007 Dufour ..... 123/638
2008/0151448 A1* 6/2008 Enomoto et al. ..... 361/57
2013/0192570 A1* 8/2013 Kajita et al. ..... 123/596
2013/0199510 A1* 8/2013 Shibata et al. ..... 123/634

* cited by examiner

IGNITION SYSTEM

CROSS-REFERENCE TO RELATED APPLICATION

This application is based on and claims the benefit of priority from earlier Japanese Patent Application No. 2012-025109 filed Feb. 8, 2012, the description of which is incorporated herein by reference.

BACKGROUND

1. Technical Field

The present disclosure relates to an ignition system for an internal combustion engine, the ignition system including a spark coil (ignition coil) that has a primary coil and a secondary coil electro-magnetically connected to the primary coil, and a spark plug that applies high voltage to a gap between a center electrode and a ground electrode on the basis of an electro-magnetic energy stored in the spark coil, thereby producing discharge sparks in between the electrodes.

2. Related Art

Recently as the trend of downsizing for vehicles progresses, a compression ratio in a spark-ignition internal-combustion engine (gasoline engine) tends to be increased by using a supercharger in order to improve fuel consumption and reduce costs. As the compression ratio become higher, an in-cylinder pressure (pressure in a cylinder) also becomes higher while discharge sparks are produced in the spark plug, thereby discharge voltage of the spark plug become higher. Once the discharge voltage becomes higher, at the time when the electrode of the spark plug is worn-out due to the increase of a running distance or the like, at an early stage from then, the discharge voltage may exceed an insulation-breakdown limit voltage of a plug insulator, thereby reliability of the spark plug is impaired. As a result, discharge sparks would no longer be produced and an accidental fire in the engine may occur.

As a measure against this, the inventors of the present disclosure have paid attention to a technique as disclosed in JP-B-H06-080313. The technique makes use of a constant-voltage element, such as a Zener diode or a Varistor, to restrict the discharge voltage of a spark plug to a predetermined voltage. Specifically, one end of the secondary coil of the spark plug is provided with a central electrode of the spark plug and a constant-voltage element that allows a current to pass therethrough when a voltage across terminals becomes equal to or higher than the predetermined voltage. Another end of the constant-voltage element is grounded.

According to this configuration, when a voltage applied across the electrodes of the spark plug is about to exceed the predetermined voltage, the applied voltage is restricted to the predetermined voltage and flattened. Thus, the conditions of the gas in the gap are made suitable for a discharge to occur for a duration that the applied voltage is maintained at the predetermined voltage, thereby discharge sparks occur in between the electrodes. With this configuration, the discharge voltage of the spark plug is prevented from becoming excessively high and thus the reliability of the spark plug can be maintained.

Owing to the use of the above mentioned technique, the discharge voltage of the spark plug is prevented from becoming excessively high. However, according to the inventors' experiments, it has been proved that the inductive voltage generated in the secondary coil is lowered more than expected. This means that discharge sparks would no longer be generated in the gap of the spark plug and an accidental fire in the engine may occur.

In light of the conditions set forth above, it is desired to provide an ignition system which is able to suppress lowering of inductive voltage generated in a secondary coil and effectively prevent the occurrence of an accidental fire in an engine.

SUMMARY

In an ignition system which includes a spark coil which is provided with a primary coil and a secondary coil electro-magnetically connected to the primary coil; and a spark plug having a center electrode and a ground electrode, the spark plug causing discharge sparks in between the both electrodes by applying a high voltage across the both electrodes on the basis of an electro-magnetic energy stored in the spark coil; the present application presents the following types of ignition system as an exemplary embodiment.

One of two ends of the secondary coil is connected to a member being a standard electrical potential via a low-voltage side path, and another end is connected to the center electrode via a connecting path. A constant-voltage path is connected with the connecting path, wherein one of ends of the constant-voltage path is grounded or connected to the side of the secondary coil of the low-voltage side path. A constant-voltage element is disposed within the constant-voltage path, wherein when electricity is supplied to the primary coil, the constant-voltage element allows current to pass through the constant-voltage path only in a specified direction that renders polarity of an inductive voltage generated in the secondary coil to turn from negative to positive, on the other hand when electricity to the primary coil is cut off and then a voltage across the terminals of the constant-voltage element becomes the specified voltage or more, the constant-voltage element allows current to pass through the constant-voltage path only in a direction opposite to the specified direction and decreases voltage equivalent to the specified voltage. The ignition system further includes a restricting element for restricting the current that passes through the constant-voltage path in the specified direction when electricity is supplied to the primary coil.

In an ignition system which does not includes a restricting element, when current is supplied to the primary coil, current passes through an electric path including the secondary coil and the constant-voltage path by the inductive voltage generated in the secondary coil. When current passes through the electric path, the current passing through the primary coil decreases and the electro-magnetic energy stored in the spark coil also decreases. Once the electro-magnetic energy stored in the spark coil decreases, inductive voltage to be generated in the secondary coil when electricity supplied to the primary coil is cut off also decreases. Under this occasion, the voltage applied across the electrodes of the spark plug is lowered and the time that the applied voltage is remained to the specified voltage is shortened.

In this regard, the typical example includes the constant-voltage element in the constant-voltage path in order to restrict voltage applied across the electrodes of the spark plug when the applied voltage is about to exceed the specified voltage. Accordingly, the current which flows in the specified direction is restricted when current is supplied to the primary coil, thereby decreasing of the electro-magnetic energy stored in the spark coil is suppressed. Thus, even though the current supplied to the primary coil is cut off, decreasing of the inductive voltage generated in the secondary coil is effectively suppressed. Thereby decreasing of the voltage applied across the electrodes of the spark plug is suppressed. Thus discharge sparks are necessarily produced in between the electrodes of the spark plug, and further an accidental fire in the engine is avoided.

The restricting element may preferably be configured to block the current flowing through the constant-voltage path in the specified direction (second aspect of the ignition system of the present invention).

With this configuration, the current flowing through the constant-voltage path in the specified direction can be blocked when electricity is supplied to the primary coil. Accordingly, when electricity is supplied to the primary coil, decreasing of current flowing therethrough can be effectively suppressed. Thus, when electricity to the primary coil (12*a*) is cut off, decrease of the inductive voltage generated in the secondary coil can be effectively suppressed.

The constant-voltage element may be a diode which causes Zener breakdown or Avalanche breakdown when the voltage across the terminals of the diode becomes equal to the specified voltage (third aspect of the ignition system of the present invention).

BRIEF DESCRIPTION OF THE DRAWINGS

In the accompanying drawings:

FIGS. 2A to 2E are diagrams illustrating a time chart of ignition control according to the first embodiment;

DETAILED DESCRIPTION OF THE PREFERRED EMBODIMENTS

With reference to the accompanying drawings, hereinafter are described some embodiments.

First Embodiment

A first embodiment in which an ignition system of the present invention is applied to an on-vehicle spark-ignition engine is hereinafter described referring to FIGS. 1 to 3.

Figure 1:
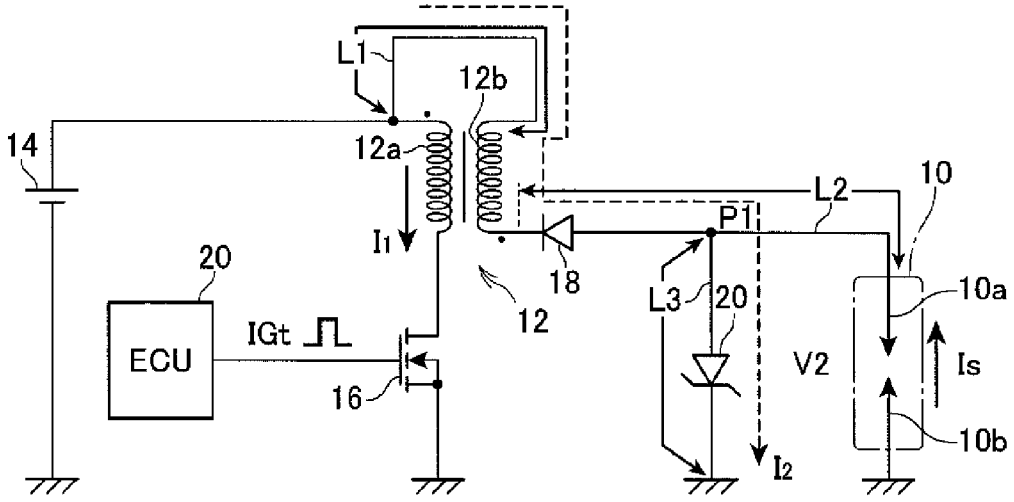
FIG. 1 is a schematic diagram illustrating an ignition system according to a first embodiment of the present invention.

A schematic diagram generally illustrating the ignition system according to the first embodiment is shown in FIG. 1.

As shown in FIG. 1, the ignition system includes a spark plug 10 and a spark coil (ignition coil) 12.

The spark plug 10 includes a center electrode 10*a* and a ground electrode 10*b*. The spark plug 10 has a function of generating discharge sparks in the combustion chamber of an engine, not shown.

The spark coil 12 includes a primary coil 12*a* and a secondary coil 12*b* electro-magnetically connected to the primary coil 12*a*. One of both ends of the secondary coil 12*b* is connected to a positive electrode of a battery 14 (corresponding to the "member being standard electrical potential" in the claims) via a low-voltage side path L1. Another end of the secondary coil 12*b* is connected to the center electrode 10*a* via a connecting path L2. The negative side of the battery 14 is grounded. In the present embodiment, a lead battery of which terminal voltage (Vb) corresponds to 12V is used as the battery 14. In the present embodiment, a grounding electric potential corresponds to 0 V.

The primary coil 12*a* has two ends, one of which is connected to the positive side of the battery 14 and another is grounded via an input/output terminal of a switching element 16 being an electronically controlled opening/closing means. In the first embodiment, the switching element 16 is comprised of an N-channel MOSFET (metal oxide semiconductor field-effects transistor).

A constant-voltage path L3 having a grounded end is connected to the connecting path L2. A diode (hereinafter referred to as block diode 18) is arranged as a restricting element within the connecting path L2 so as to be positioned between a secondary coil 12*b* and a position (P1) where the constant voltage path L3 is connected to the connecting path L2. Also a Zener diode 20 is disposed as a constant-voltage element within the constant-voltage path L3. Specifically, each anode of the block diode 18 and the Zener diode 20 is mutually connected.

An electronic control unit (hereinafter referred to as ECU 22) is mainly configured by a microcomputer to control the ignition system. The ECU 22 outputs an ignition signal IGt to the opening/closing control terminal (gate) of the switching element 16 for allowing the spark plug 10 to produce discharge sparks.

Next, ignition control carried by ECU 22 will be explained. At the time that an ignition signal IGt which is inputted to a gate of the switching element 16 is turned ON, the switching element 16 becomes ON state. Herewith primary current I1 flows from the battery 14 to the primary coil 12*a*, and then storage of electro-magnetic energy to the spark coil 12 starts. In this first present embodiment, in the case where current is supplied to the primary coil 12*a*, one end of the secondary coil 12*b* being connected to a center electrode 10*a* of the ignition coil 10 becomes positive, on the other hand, another end of the secondary coil 12*b* being connected to a low-voltage side path L1 becomes negative.

After electricity supply to the primary coil 12*a* is ended, when the ECU 22 outputs an off-signal (hereinafter, this signal is referred to as "OFF-ignition signal IGt") and then the switching element 16 into an off-state, the polarities of both ends of the secondary coil 12*b* are mutually reversed and then high voltage is induced to the secondary coil 12*b*. Thus, high voltage is applied to the gap between the center electrode 10*a* and the ground electrode 10*b* of the spark plug 10.

In this first embodiment, the Zener diode 20 is disposed within the constant-voltage path L3. Therefore, when the voltage (secondary voltage V2) applied to the gap of the spark plug 10 is about to exceed a breakdown voltage Vz of the Zener diode 20, voltage drop of which amount corresponds to the breakdown voltage Vz occurs at the Zener diode 20, and then the secondary voltage V2 is restricted to the level of breakdown voltage Vz. Specifically, in a duration when the secondary voltage V2 is about to exceed the breakdown voltage Vz, the secondary voltage V2 is maintained to the value of the breakdown voltage Vz.

When the conditions of the gas in the gap become suitable for discharge in the period when the secondary voltage V2 maintains a value of the breakdown voltage Vz, discharge sparks are produced in the gap. At the same time, a current (discharge current Is) flows from the ground electrode 10*b* to the center electrode 10*a*. With this configuration, the discharge voltage of the spark plug 10 is prevented from becoming higher.

In this first embodiment, the breakdown voltage Vz of the Zener diode 20 is set to a level higher than the discharge voltage of a brand-new spark plug 10 (i.e. initially used spark plug 10) and lower than an allowable upper limit of the discharge voltage (upper-limit withstand voltage). This is set in order to prevent the discharge voltage from becoming excessively high due to the advanced deterioration of the spark plug 10, such as the advanced abrasion of the electrodes, which is caused by the long use of the spark plug 10.

Hereinafter a function of the block diode 18 that is a configuration characteristic of the present embodiment will be described.

As described above, when the voltage applied to the gap of the spark plug 10 is about to exceed the breakdown voltage Vz, the applied voltage maintains a value of the breakdown voltage Vz. However, when the inductive voltage generated in the secondary coil 12*b* decreases, this decrease unavoidably shortens the period when the applied voltage maintains a value of the breakdown voltage Vz (hereinafter this period is referred to as constant-voltage duration). As a measure against this, the block diode 18 is arranged in the connecting path L2. That is to say, the block diode 18 serves as an element which helps to maintain the constant-voltage duration. In the present embodiment, a breakdown voltage Vlimit of the block diode 18 is set to a value larger than a maximum value (e.g., 1.5 kV to 3 kV) of a difference of electric potential. The difference of electric potential in this case corresponds to a difference of electric potential between the anode and the cathode of the block diode 18 when current is passed through the primary coil 12*a*. Specifically, a number of turns N2 of the secondary coil 12*b* relative to a number of turns N1 of the primary coil 12*a* (N2/N1) is calculated first. The resultant value is multiplied with the terminal voltage Vb of the battery 14. The breakdown voltage Vlimit is set to a value equal to or larger than the value resulting from the multiplication. Thus, a set value of the breakdown voltage Vlimit is derived so as to satisfy the following relation:

$$Vlimi \geq (N2/N1)*Vb \text{ (* indicates multiplication)}$$

Thus, even when electricity is supplied to the primary coil 12*a*, the current does not pass through from a cathode to an anode in the block diode 18.

Figure 2A:
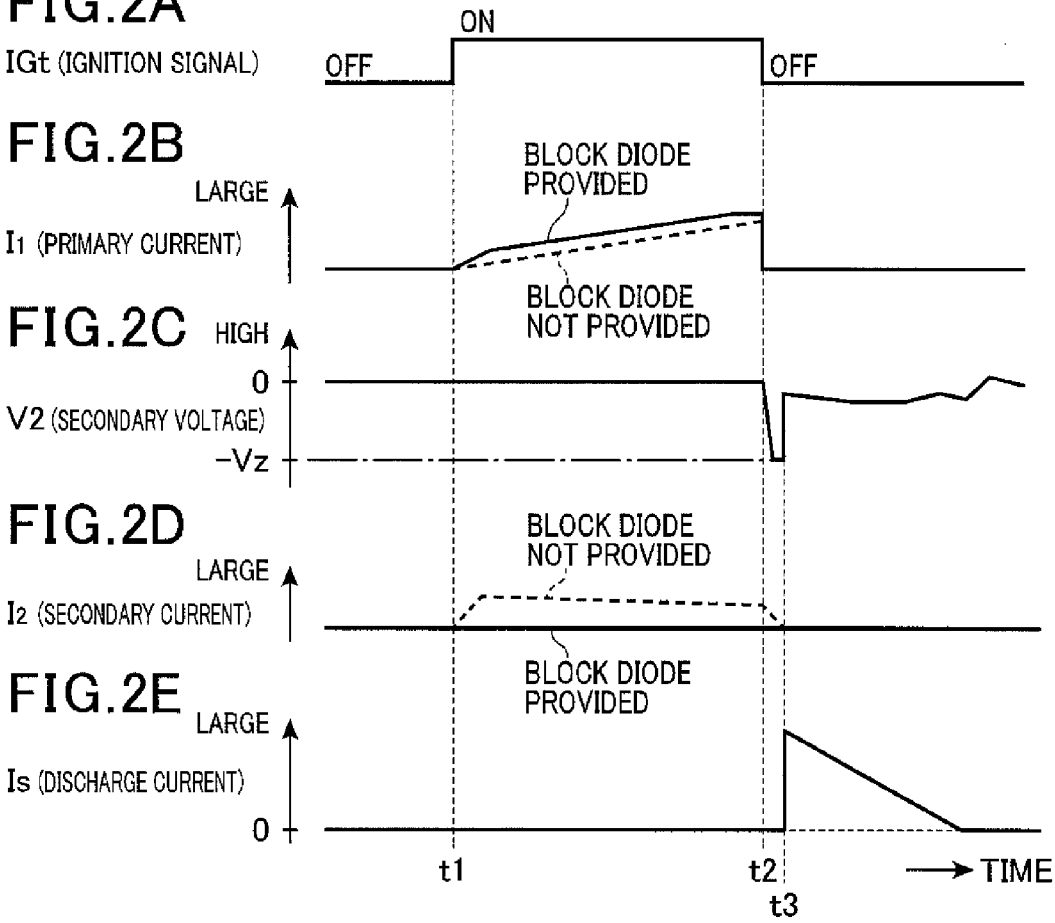

Referring to FIG. 2A to FIG. 2E, a function of the block diode 18 is specifically explained. FIG. 2A to FIG. 2E shows an example of a time chart of ignition control. Specifically, FIG. 2A shows transition of the ignition signal IGt. FIG. 2B shows transition of the primary current I1. FIG. 2C shows transition of the secondary voltage V2. FIG. 2D shows transition of current (secondary current I2) passing through the Zener diode 20. FIG. 2E shows transition of the discharge current Is. As shown in FIG. 1, the primary current I1 that flows in a direction from the battery 14 toward the switching element 16 is herein defined to be positive. The secondary current I2 that flows through the Zener diode 20 in a direction from an anode toward a cathode is herein defined to be positive. The discharge current Is that flows in a direction from the ground electrode 10*b* toward the center electrode 10*a* is herein defined to be positive.

First, a case the ignition system does not include the block diode 18 will be explained.

As indicated by the broken line in FIG. 2B, the primary current I1 starts to gradually increase at time t1 when the OFF-ignition signal IGt is switched to the ON-ignition signal IGt (i.e. the ignition signal IGt is switched ON). However, under the conditions where current is passed through the primary coil 12*a*, the secondary current I2 passes through the constant-voltage path L3 from the secondary coil 12*b* toward the Zener diode 20. Therefore, the primary current I1 decreases to thereby decrease the electro-magnetic energy stored in the spark coil 12. Accordingly, the inductive voltage generated in the secondary coil 12*b* decreases at time t2 when the ON-ignition signal IGt is switched to the OFF-ignition signal IGt (i.e. the ignition signal IGt is switched off). Further, the constant-voltage duration of the spark plug 10 is shortened. FIG. 2D omits the indication of a current that passes through the Zener diode 20 in the period when the secondary voltage V2 maintains a value of the breakdown voltage Vz.

Secondly, a case that the ignition system includes block diode 18 will be explained.

In a case where the ignition system is provided with the block diode 18, as indicated by the solid line in FIG. 2D, the secondary current I2 which tends to pass through the constant-voltage path L3 is blocked in a period from time t1 to time t2 during which the ON-ignition signal IGt is outputted. As a result, decreasing of the primary current I1 is restricted. Accordingly, decreasing of the electro-magnetic energy stored in the spark coil 12 is restricted, and thereby reduction of the constant-voltage duration of the spark plug 10 is restricted.

As shown in FIG. 2C and FIG. 2E, discharge sparks are produced at time t3 in the spark plug 10 and at the same time the discharge current Is flows.

Figure 3:
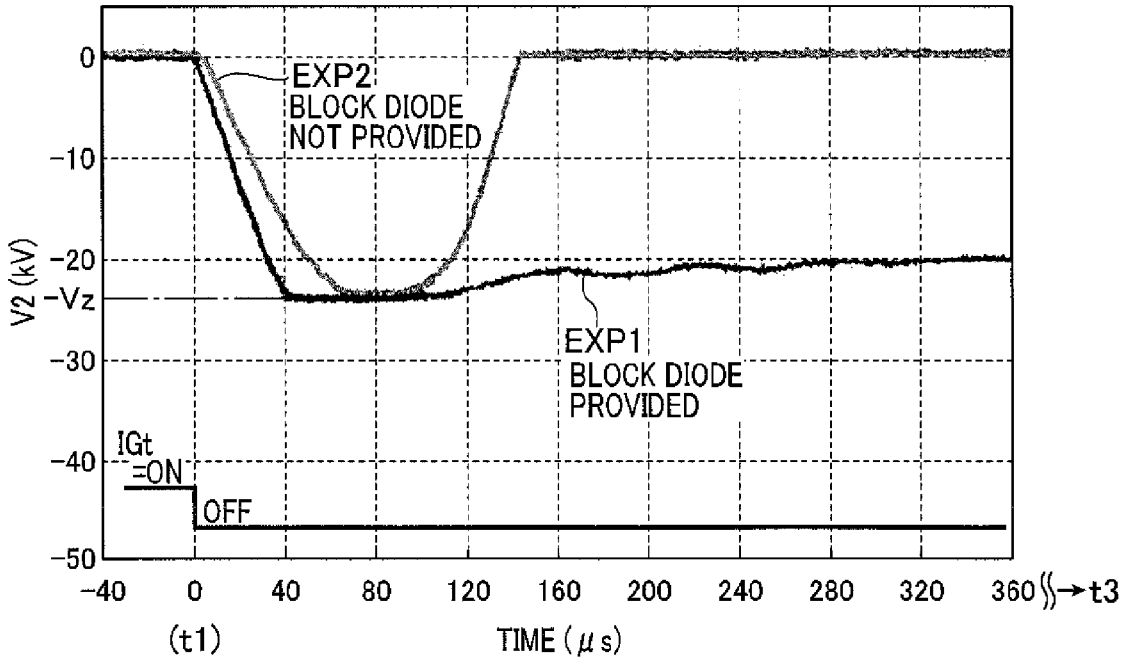
FIG. 3 is a diagram illustrating the effects of a block diode according to the first embodiment.

FIG. 3 is a diagram showing measurement result of waveform of the secondary voltage V2 in a period from when the OFF-ignition signal IGt is outputted (t2) until when discharge sparks are produced (t3). Specifically, in FIG. 3, EXP1 indicates the measurement result of the waveform in the case where the constant-voltage path L3 is provided with the block diode 18. Also, EXP2 indicates the measurement result of the waveform in the case where the constant-voltage path L3 is not provided with the block diode 18.

As shown in FIG. 3, the constant-voltage duration of the spark plug 10 including the block diode 18 is longer than that of the spark plug 10 not including the block diode 18. Thus, as will be understood from FIG. 3, the block diode 18 is able to enhance the storage of the electro-magnetic energy to the spark coil 12.

As shown in FIG. 1, the block diode 18 is disposed within the connecting path L2 at the portion which is near the secondary coil 12*b* than the point (P1) where the constant-voltage path L3 is connected to the connecting path L2. In this configuration, the breakdown voltage Vlimit of the block diode 18 is set to a value to be able to block the current which tends to flow from the cathode to the anode of the block diode 18 when electricity is supplied to the primary coil 12*a*. Thus, decreasing of the inductive voltage generated in the secondary coil 12*b* is restricted when the ignition signal IGt is switched off. As a result, shortening of the constant-voltage duration of the spark plug 10 is effectively prevented. In this way, the occurrence of an accidental fire in the engine is effectively prevented.

Second Embodiment

Figure 4:
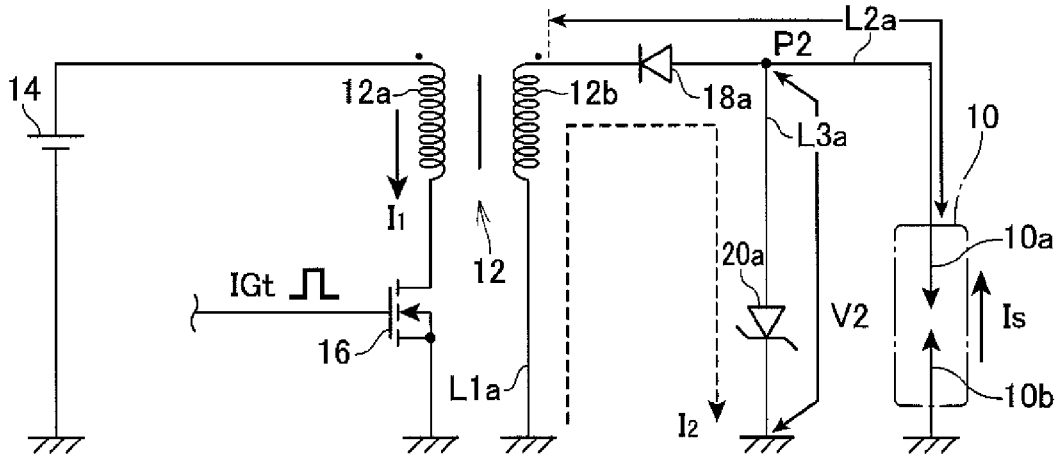
FIG. 4 is a schematic diagram illustrating an ignition system according to a second embodiment of the present invention.

Referring now to FIG. 4, hereinafter is described a second embodiment of the present invention. The second embodiment is described focusing on differences from the first embodiment. In the second and the subsequent embodiments as well as modifications, the components identical with or similar to those in the first embodiment are given the same reference numerals for the sake of omitting unnecessary explanation.

FIG. 4 is a schematic diagram illustrating an ignition system according to the second embodiment. It should be appreciated that the ECU 22 is omitted from FIG. 4.

As shown in FIG. 4, one end of the secondary coil 12*b* is grounded via a low-voltage side path L1*a*, while the other end thereof is connected to the center electrode 10*a* via a connecting path L2*a*.

The connecting path L2*a* is connected to one end of a constant-voltage path L3*a* of which the other end is grounded. A block diode 18*a* is disposed within the connecting path L2*a* at the portion between a secondary coil 12*b* and a point (P2) where the constant-voltage path L3*a* is connected to the connecting path L2*a*. A Zener diode 20*a* is disposed within the constant-voltage path L3*a*. Specifically, each anode of the block diode 18*a* and the Zener diode 20*a* is mutually connected.

With this configuration, when the ON-ignition signal IGt is inputted to the gate of the switching element 16, the primary current I1 is supplied from the battery 14 to the primary coil 12*a*. With the start of this current supply, electro-magnetic energy is started to be stored in the spark coil 12. In this second embodiment, when electricity is supplied to the primary coil 12*a*, polarity of the side of a center electrode 10*a* of the secondary coil 12*b* will be positive, and polarity of the side of the a low-voltage side path L1*a* thereof will be negative.

When the OFF-ignition signal IGt is outputted after current is supplied to the primary coil 12*a*, the polarities at both ends of the secondary coil 12*b* are mutually reversed and, at the same time, high voltage is applied to the gap of the spark plug 10.

Hereinafter is described a function of the block diode 18*a* according to the second embodiment.

In a case where the ignition system does not include the block diode 18*a*, the secondary current I2 passes through the constant-voltage path L3*a* from the secondary coil 12*b* toward the Zener diode 20*a*, under the conditions where current is passed through the primary coil 12*a*. As a result, as described in the first embodiment, the primary current I1 decreases, and thereby the electro-magnetic energy stored in the spark coil 12 also decreases.

On the other hand, when the ignition system includes the block diode 18*a*, the flow of the secondary current I2 is blocked. Thus, the effects similar to those of the first embodiment can be obtained.

Third Embodiment

Figure 5:
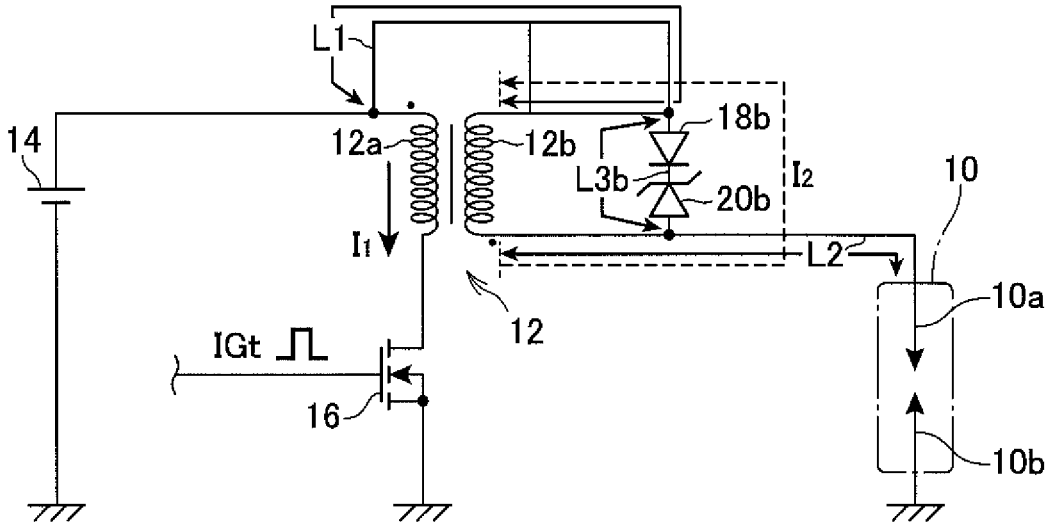
FIG. 5 is a schematic diagram illustrating an ignition system according to a third embodiment of the present invention.

Referring to FIG. 5, hereinafter is described a third embodiment of the present invention. The third embodiment is described focusing on differences from the first embodiment.

FIG. 5 is a schematic diagram illustrating an ignition system according to the third embodiment. It should be appreciated that the ECU 22 is also omitted from FIG. 5.

As shown in FIG. 5, one end of the low-voltage side path L1, which is connected to a one end of a secondary coil 12*b*, is connected to the connecting path L2 via a constant-voltage path L3*b*. The constant-voltage path L3*b* is provided with a block diode 18*b* and a Zener diode 20*b* successively from the side of low-voltage side path L1. The block diode 18*b* and the Zener diode 20*b* are serially connected. Specifically, each cathode of the block diode 18*b* and of the Zener diode 20*b* is mutually connected.

With this configuration, when the ON-ignition signal IGt is switched to the OFF-ignition signal IGt and the inductive voltage of the secondary coil 12*b* is about to exceed the breakdown voltage Vz of the Zener diode 20*b*, the inductive voltage is restricted to the breakdown voltage Vz. In other words, the voltage applied to the gap maintains a value of the breakdown voltage Vz.

Hereinafter is described a function of the block diode 18*b* according to the present embodiment.

Let us discuss the case where the ignition system does not include the block diode 18*b* and electricity is supplied to the primary coil 12*a*. In this case, the secondary current I2 flows through a closed loop circuit that includes the secondary coil 12*b* and the constant-voltage path L3*b*. The direction of the flow of the secondary current I2 in the closed loop circuit is from positive (+) end of the secondary coil 12*b* toward the constant-voltage path L3*b* (see FIG. 5). Thus, as described in the first embodiment, the primary current I1 decreases, and thereby the electro-magnetic energy stored in the spark coil 12 also decreases.

On the other hand, when the ignition system includes the block diode 18*b*, the flow of the second current I2 can be blocked.

In this way, in this second embodiment, the effects similar to those of the first embodiment can be obtained.

Further, the second embodiment includes the circuit configuration in which one end of the constant-voltage path L3*b* is not grounded. Accordingly, this can eliminate a ground terminal on a vehicle for connecting the constant-voltage path L3*b*, thereby the degree of freedom for mounting the ignition system to a vehicle may be increased.

Modifications

The embodiments described above may be implemented with the following modifications.

The position of arranging the block diode is not limited to the positions exemplified in the first to third embodiments.

Figure 6:
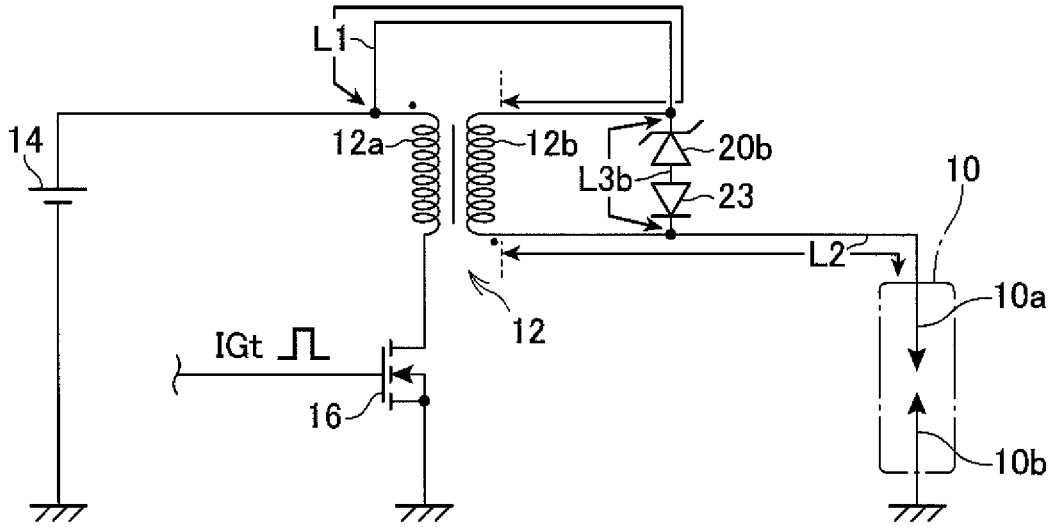
FIG. 6 is a schematic diagram illustrating an ignition system according to a modification of the third embodiment.

For example as shown in FIG. 6, as one modification of the third embodiment, the position of the block diode 23 and the Zener diode 20*b* can be mutually reversed. Not only that, the block diode 23 can be arranged at any position within the closed loop circuit that includes the secondary coil 12*b* and the constant-voltage path L3*b*.

Figure 7A:
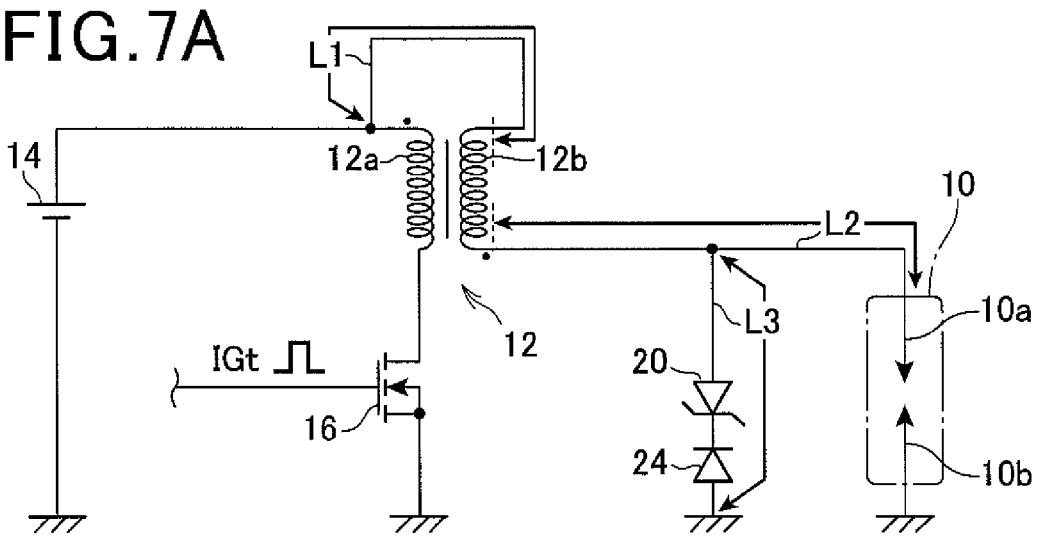
FIGS. 7A to 7C are schematic diagrams each illustrating an ignition system according to a modification of the first embodiment.
Figure 7B:
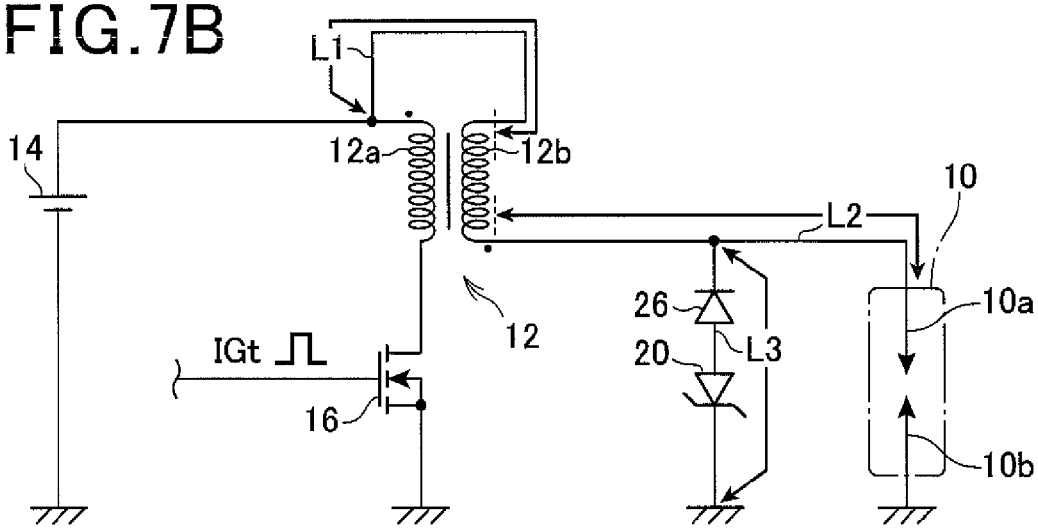
Figure 7C:
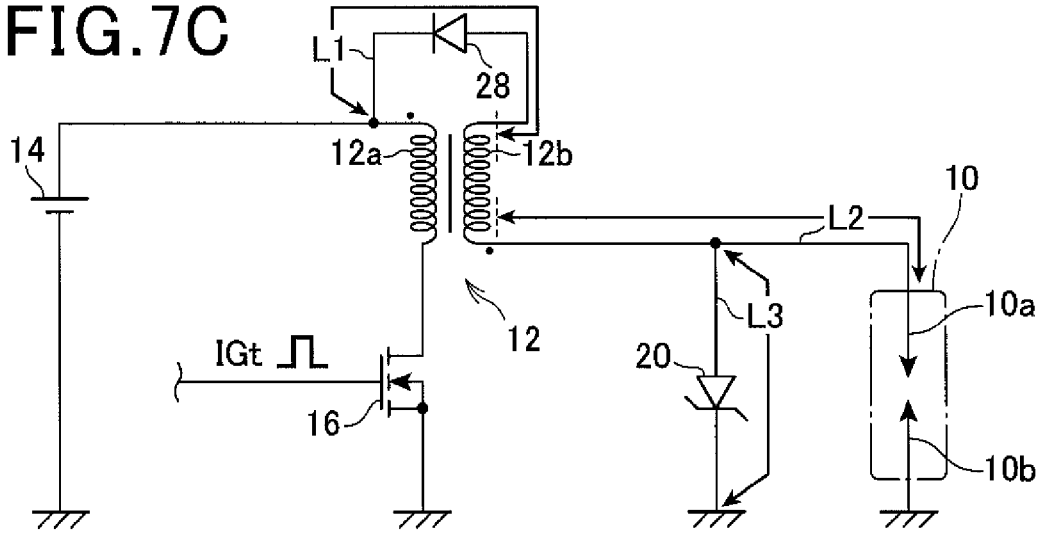

Further, for example as shown in FIG. 7A, as one modification of is the first embodiment, a block diode 24 can be arranged within the constant-voltage circuit L3 so as to be positioned between the Zener diode 20 and the grounding portion. Not only that, as shown in FIG. 7B, as other modification of the first embodiment, a block diode 26 can be arranged within the constant-voltage path L3 so as to be positioned between the Zener diode 20 and the connecting path L2. Furthermore, as shown in FIG. 7C, a block diode 28 can be arranged within the low-voltage side path L1.

Figure 8A:
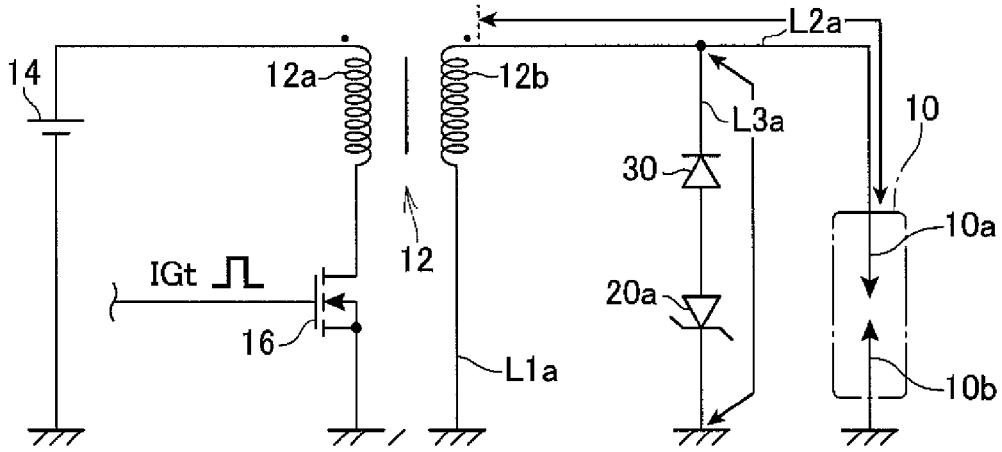
FIGS. 8A to 8C are schematic diagrams each illustrating an ignition system according to a modification of the second embodiment.
Figure 8B:
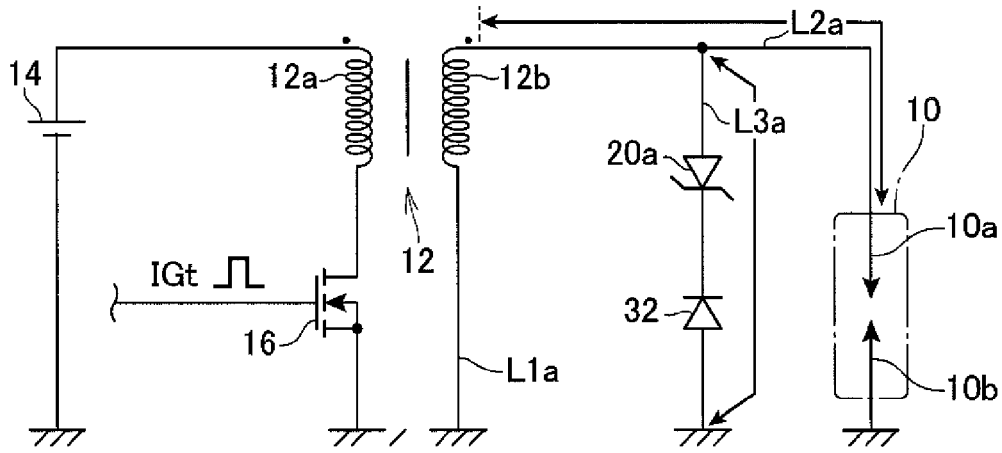
Figure 8C:
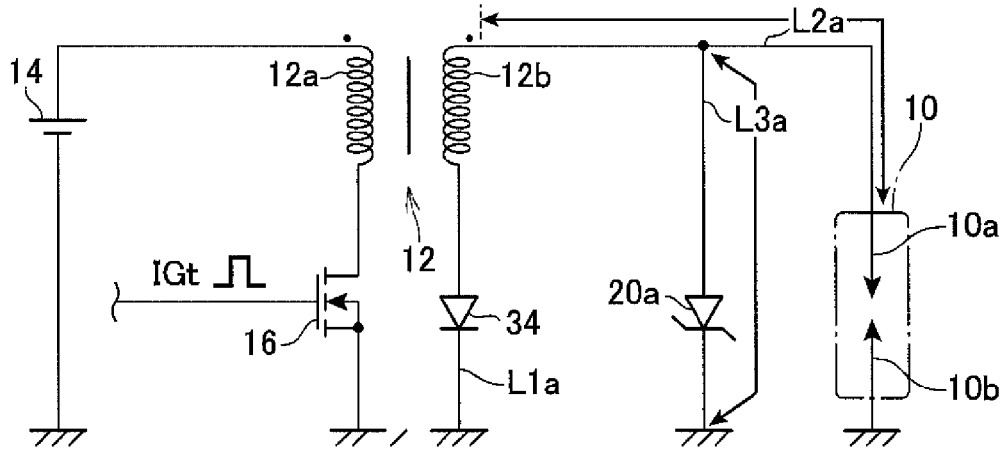

Furthermore, for example as shown in FIG. 8A, as one modification of the second embodiment, a block diode 30 can be arranged within the constant-voltage path L3*a* between the Zener diode 20*a* and a connecting path L2*a*. Not only that, as shown in FIG. 8B, as other modification of the second embodiment, a block diode 32 can be arranged within the constant-voltage path L3*a* so as to be positioned between the Zener diode 20*a* and a grounding portion. Furthermore, as shown in FIG. 8C, a block diode 34 can be arranged within a low-voltage side path L1*a*.

The setting method for the breakdown voltage Vlimit of the block diode is not limited to the ones exemplified in the above embodiments.

For example, the breakdown voltage Vlimit may be set to a value smaller than a maximum value of the voltage applied across the anode and the cathode of the block diode when electricity is supplied to the primary coil 12*a*, and larger than a minimum value of the voltage applied across the anode and the cathode thereof at the timing when current supply to the primary coil 12*a* is cut off. The inductive voltage generated in the secondary coil 12*b* when electricity is supplied to the primary coil 12*a* tends to gradually decrease from the timing when current supply to the primary coil 12*a* is started. Accordingly, the flow of current can be blocked on or after the timing when the applied voltage becomes smaller than the breakdown voltage Vlimit when electricity is supplied to the primary coil 12*a*. In this way, decreasing of the electro-magnetic energy stored in the spark coil 12 is restricted.

The number of block diodes arranged in ignition system is not limited to one but may be two or more.

As mentioned above, the circuit configuration of the ignition system in each of the embodiments described above is based on what is called "negative discharge" in which discharge current flows from the ground electrode to the center electrode of the spark plug when the ignition signal IGt is switched off, with which the center electrode serving as a negative electrode and the ground electrode serving as a positive electrode. However, the circuit configuration is not limited to this. For example, the circuit configuration may be based on what is called "positive discharge" in which discharge current flows from the center electrode to the ground electrode when the ignition signal IGt is switched off, with which the center electrode serving as a positive electrode and the ground electrode serving as a negative electrode. In this occasion, in FIG. 4, the secondary coil 12*b* should be provided such that, the polarity of the center electrode 10*a* of the secondary coil 12*b* will be negative and the polarity of the low-voltage side path L1*a* thereof will be positive when electricity is supplied to the primary coil 12*a*. When electricity is supplied to the primary coil 12*a*, in the secondary coil 12*b*, current tends to flow from the side of the center electrode 10*a* toward the low-voltage side path L1*a*. Hence, the block diode 18*a* should be arranged between a secondary coil 12*b* and a portion (P2) that the constant-voltage path L3*a* is connected to the connecting path L2*a* such that the anode of the block diode 18*a* is connected to the secondary coil 12*b* and its cathode is connected to the center electrode 10*a*. In this occasion, the Zener diode 20*a* should be provided within the constant-voltage path L3*a*, such that the anode of the Zener diode 20*a*—is connected to the grounding portion and its cathode is connected to the connecting path L2*a*.

The switching element 16 is not limited to a MOSFET. A bipolar transistor is possible.

The constant-voltage element is not limited to the one exemplified in each of the above embodiments. For example, Avalanche diode can be used as the constant-voltage element, causing Avalanche breakdown when a voltage across the terminals becomes equal to a specified voltage. Alternatively, an element other than Zener diode or Avalanche diode can be used as the constant-voltage element, provided that the element has functions similar to those of the Zener diode or Avalanche diode.

The block diode is not limited to the one exemplified in each of the above embodiments. Zener diode is also suitable as the block diode.

What is claimed is:

1. An ignition system, comprising:

a spark coil which is provided with a primary coil and a secondary coil electro-magnetically connected to the primary coil, and a spark plug having a center electrode and a ground electrode, the spark plug causing discharge sparks in between the electrodes by applying a high voltage across the electrodes on the basis of an electro-magnetic energy stored in the spark coil; wherein one of two ends of the secondary coil is connected to a member which is at a standard electrical potential via a low-voltage side path, and another end is connected to the center electrode via a connecting path;

a constant-voltage path is connected with the connecting path, wherein one of ends of the constant-voltage path is grounded or connected to the side of the secondary coil of the low-voltage side path;

a constant-voltage element is disposed within the constant-voltage path, wherein when electricity is supplied to the primary coil, the constant-voltage element allows current to pass through the constant-voltage path only in a specified direction that renders polarity of an inductive voltage generated in the secondary coil to turn from negative to positive, and when electricity to the primary coil is cut off and then a voltage across the terminals of the constant-voltage element becomes the specified voltage or more, the constant-voltage element allows current to pass through the constant-voltage path only in a direction opposite to the specified direction and decreases voltage equivalent to the specified voltage; and the ignition system further includes a restricting element for restricting the current that passes through the constant-voltage path in the specified direction when electricity is supplied to the primary coil.

2. The ignition system according to claim 1, wherein the restricting element is configured to completely block the current flowing through the constant-voltage path in the specified direction.

3. The ignition system according to claim 1, the constant-voltage element is a diode which causes Zener breakdown or Avalanche breakdown when the voltage across the terminals of the diode has become equal to the specified voltage.

4. The ignition system according to claim 2, the constant-voltage element is a diode which causes Zener breakdown or Avalanche breakdown when the voltage across the terminals of the diode has become equal to the specified voltage.

* * * * *